US008453274B1

(12) United States Patent
Olmstead

(10) Patent No.: US 8,453,274 B1
(45) Date of Patent: Jun. 4, 2013

(54) GEL ENCLOSED BEDPAN

(76) Inventor: Lisa M. Olmstead, Woodstock, VT (US)

( * ) Notice: Subject to any disclaimer, the term of this patent is extended or adjusted under 35 U.S.C. 154(b) by 786 days.

(21) Appl. No.: 12/611,881

(22) Filed: Nov. 3, 2009

(51) Int. Cl.
*A61G 9/00* (2006.01)

(52) U.S. Cl.
USPC ..... 4/456

(58) Field of Classification Search
USPC ..... 4/456, 450
See application file for complete search history.

(56) References Cited

U.S. PATENT DOCUMENTS

| | | | | |
|---|---|---|---|---|
| 1,924,204 | A | 8/1933 | Young | |
| 2,242,088 | A * | 5/1941 | Rainboth | 4/456 |
| 2,817,093 | A | 12/1957 | Rode | |
| 3,939,502 | A | 2/1976 | Miller | |
| 4,136,798 | A | 1/1979 | Oberstein | |
| 4,437,195 | A | 3/1984 | Mangels | |
| 4,827,540 | A | 5/1989 | Stokes | |
| 5,079,788 | A | 1/1992 | Raupp | |
| 5,394,571 | A | 3/1995 | Vernon | |
| 5,819,334 | A | 10/1998 | Maze | |
| 6,370,704 | B1 * | 4/2002 | White, Jr. | 4/237 |
| 6,851,132 | B1 | 2/2005 | Jones-Lowe | |
| 2007/0094777 | A1 * | 5/2007 | Bryant | 4/237 |
| 2009/0126090 | A1 * | 5/2009 | Chen | 4/237 |
| 2010/0107326 | A1 * | 5/2010 | Joseph | 4/457 |

FOREIGN PATENT DOCUMENTS

| | | |
|---|---|---|
| CN | 2393475 | 8/2000 |
| GB | 1413308 | 11/1975 |

* cited by examiner

*Primary Examiner* — Huyen Le
(74) *Attorney, Agent, or Firm* — Michael I. Kroll

(57) ABSTRACT

A polymer gel enclosure that encompasses a bedpan to increase the comfort of the user and decrease the risk of irritation and injury thereto.

6 Claims, 10 Drawing Sheets

GEL ENCLOSED BEDPAN

BACKGROUND OF THE INVENTION

1. Field of the Invention

The present invention relates generally to bedpans and, more specifically to a gel-enclosed bedpan. Bedpans are usually used by the sick and infirm that frequently have sensitive skin and bedsores. The bedpans of the prior art often serve to exacerbate the problem due to their rigid nature. The present invention seeks to overcome these problems by providing a bedpan enclosed by a gel filled polymeric coating having no seams. The gel enclosed bedpan is capable of being heated and sterilized as desired.

2. Description of the Prior Art

There are other bedpan device designed for human waste. Typical of these is U.S. Pat. No. 1,924,204 issued to Young on Aug. 29, 1933.

Another patent was issued to Rode on Dec. 24, 1957 as U.S. Pat. No. 2,817,093. Yet another U.S. Pat. No. 3,939,502 was issued to Miller on Feb. 24, 1976 and still yet another was issued on Jan. 30, 1979 to Oberstein as U.S. Pat. No. 4,136,798.

Another patent was issued to Mangels on Mar. 20, 1984 as U.S. Pat. No. 4,437,195. Yet another U.S. Pat. No. 4,827,540 was issued to Stokes on May 9, 1989. Another was issued to Raupp on Jan. 14, 1992 as U.S. Pat. No. 5,079,788 and still yet another was issued on Mar. 7, 1995 to Vernon as U.S. Pat. No. 5,394,571.

Another patent was issued to Maze on Oct. 13, 1998 as U.S. Pat. No. 5,819,334. Yet another U.S. Pat. No. 6,851,132 was issued to Jones-Lowe on Feb. 8, 2005. Another was issued to Kimbro, Jr. on Nov. 12, 1975 as U.K. Patent No. GB1413308 and still yet another was issued on Aug. 30, 2000 to Maofeng as Chinese Patent No. CN 2393475.

For use with a bed pan having a bottom, a side wall and an inturned seat flange spaced from said bottom, a cushion member, said cushion member including a seat portion shaped to conform to the bed pan seat flange and adapted to be positioned thereon, said cushion member including a continuous band of elastic rubber arranged about the periphery of said seat portion and continued therefrom to form a resilient closed loop, said loop being adapted to resiliently engage a bed pan side wall.

A bedpan cushion comprising: an elastic rubber receptacle adapted to be stretched under and around the bedpan for enclosing same under tension, a substantially U-shaped pad of substantially plano-convex cross section mounted on the seat flange of the bedpan, said receptacle including an inwardly, downwardly and then outwardly folded top portion enclosing the pad, and clips mounted beneath said outwardly folded portion of said top portion of said receptacle and yieldingly engageable by the tension of said receptacle with the inner marginal portion of the seat flange for anchoring the pad thereon.

A disposable comfort pad for bedpans having a pad member shaped to cover the flesh-engaging seat portion of a bed pan. The bottom or underside of the pad member, at least in the distal end areas and bight portion area, is coated with pressure sensitive adhesive which is shielded prior to use of the pad by sheet material which can be readily stripped away. At least one, and preferably three, pull tabs or loops project from the pad member for use in removing the pad from a bedpan. The pad member has an inexpensive filling within an envelope or cover formed of soft, thin, plastic film.

A bag constructed of biodegradable material in the form of high dry-strength and no wet-strength paper combined with water-soluble plastic material laminated to a portion of the exterior of the bag. The bag is of a size to receive a bedpan as specifically disclosed but it may also be of a size to receive an emesis pan or the like when inserted therein with the bag completely enclosing the pan to maintain the aseptic characteristics of a sterile pan by completely preventing any possible contact between the pan and the patient or excreta from a patient thereby eliminating the necessity of cleaning and sterilizing bedpans, emesis pans and the like which results in substantial saving of time, labor and cost of caring for a patient. The bag, after use, is easily separated from the pan and flushed into the sewer system through a conventional commode with the water soluble plastic being dissolved by the flushing water and the paper becoming disintegrated so that the plumbing system will not become clogged. The water soluble plastic has the characteristic of maintaining its strength and impermeability characteristics at temperatures above approximately 60 degrees F. so that excreta at body temperature will not dissolve the plastic material. However, the plastic becomes dissolved by water at temperatures below approximately 60 degrees F. so that when it is placed in a commode hopper or the like the flushing water which is at a temperature below approximately 60 degrees F. will dissolve the plastic material. The bag will also eliminate the use of bedpan liners, prevent staining of plastic pans, prevent odor from penetrating into plastic pans, extend the life of conventional pans, eliminate cold bed pans and assure the patient that the bedpans, emesis pan and the like is, in fact, sterile.

A self-inflating bedpan having means for readily, manually inflating the bedpan after it is positioned beneath a patient.

A disposable combination bedpan cushion and waste bag assembly having a cushion top formed into the size and shape of the seat portion of a bedpan and including a center opening similar to that of the seat portion of the bedpan. The waste bag is permanently attached to the cushion top to enclose the center opening from below. The waste bag is sealed after use. The cushion top is formed from layers of plastic-backed adhesive, rigid plastic, and cotton padding. An inner rim is provided around the inner periphery of the center opening to allow the cushion top to snugly fit onto a seat of a bed pan. In the preferred embodiment, an angular plastic clip is included as part of the assembly to secure the cushion top onto the bedpan.

A bedpan which provides ease of use through its low lying configuration while also minimizing pain typically associated with pan usage by providing contoured, padded surfaces that complement the user's body contour.

An inflatable bedpan assembly having an inflatable horseshoe-shaped seat and a detachable waste collection bag which is sealed by use of a drawstring is provided. The bedpan is almost flat in its deflated condition and has a shape similar to a thick toilet seat when inflated. A waste collection bag substitutes for the bowl in a regular toilet. The bag is inserted prior to use, then is pulled out through a gap in the front of the seat. The bag closes and seals as it is pulled out. The collection bag is attached to the bedpan by means of a sleeve which is around the opening of the bag and which contains a drawstring. The sleeve containing the drawstring is wedged into a groove or channel formed around the inner circumference of the seat just below the top surface. After use, the drawstring and sleeve, with the suspended collection bag, are pulled out of the groove in the horseshoe and removed through the front gap.

An all plastic bedpan has a seat with textured upper surface which prevents the formation of surface tension and provides air passageways at the interface between the patient and the textured seat surface.

A padded seat is provided, similar to a toilet seat, that is attached or clipped to a conventional bedpan. Friction fit snaps are provided for attaching the padded cushion to a bedpan. The snap on/snap off design extends the versatility of existing bedpans while remaining easy to empty and clean. The padded nature is not only more physically comfortable for the user, it also provides a psychological advantage for those who find it difficult to use a bedpan as well.

Bedpan apparatus or apparatus for providing access for medical treatment of a patient, comprises a base 1 for sliding beneath a supine patient and supporting a crescent or generally U-shaped inflatable cushion 2 and a bedpan 10 adapted to fit between the limbs 6 of the cushion, said cushion being provided with a flexible conduit 7 and a valve 8 enabling the cushion to be inflated to lift the saccrococcygeal area of the patient and to be deflated after use of the bedpan. The base 1 extends over plan-view, beyond the cushion and the apparatus may be used without a bedpan to provide access to the patient for medical treatment. A flange 3 extends inwardly and downwardly from the inner surface of the cushion and overlies the rim 4 of the bedpan. The bedpan is curved upwardly at 9 to form a splashguard and has a handle 11. The base 1 is formed by a waterproof flexible pad and the intermediate section 5 of the cushion inflates to a higher level than that of the limbs 6. The conduit 7 may be integral with the base 1.

The utility model relates to a disposable sanitary seat cushion for a sitting-type bedpan, which is characterized in that the utility model is composed of a cushion ring and a splash-proof sheet, wherein, the cushion ring is a cushion sheet which is laid on a seat of the sitting type bedpan, the middle part of the cushion ring is provided with an inner hole, the splash-proof sheet is a thin film which is laid on a catharsis hole of the sitting-type bedpan, and the thin film is easy to dissolve in water. The utility model causes a user not only to be satisfied mentally, and actually, the sanitary effect is reached. The utility model also avoids the phenomenon that falling feces impacts water spot to spill to buttocks.

While these bed pans may be suitable for the purposes for which they were designed, they would not be as suitable for the purposes of the present invention, as hereinafter described.

SUMMARY OF THE PRESENT INVENTION

A primary object of the present invention is to provide a gel enclosed bed pan to provide comfort and increased health benefits for the user.

Another object of the present invention is to provide a gel enclosed bed pan wherein the bed pan serves as a rigid internal skeletal structure for an amount of gel covered by a polymeric skin providing full coverage thereover.

Yet another object of the present invention is to provide a gel-enclosed bedpan wherein said polymeric cover has no seams.

Still yet another object of the present invention is to provide a gel-enclosed bedpan wherein said polymeric cover is heat and chemical resistant whereby said bedpan can be sterilized as desired.

Another object of the present invention is to provide a gel enclosed seat cover having an appropriate amount of gel over the seat area so that the seat portion will deform to the shape of the user.

Yet another object of the present invention is to provide gel-enclosed bedpans that can be easily stacked.

Still another object of the present invention is to provide an alternate gel enclosed sleeve that can be placed on existing bed pans thereby providing the advantages of seat deformability as provided by the present invention.

Additional objects of the present invention will appear as the description proceeds.

The present invention overcomes the shortcomings of the prior art by providing a polymer gel enclosure that encompasses a bedpan to increase the comfort of the user and decrease the risk of irritation and injury thereto.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Figure 9:
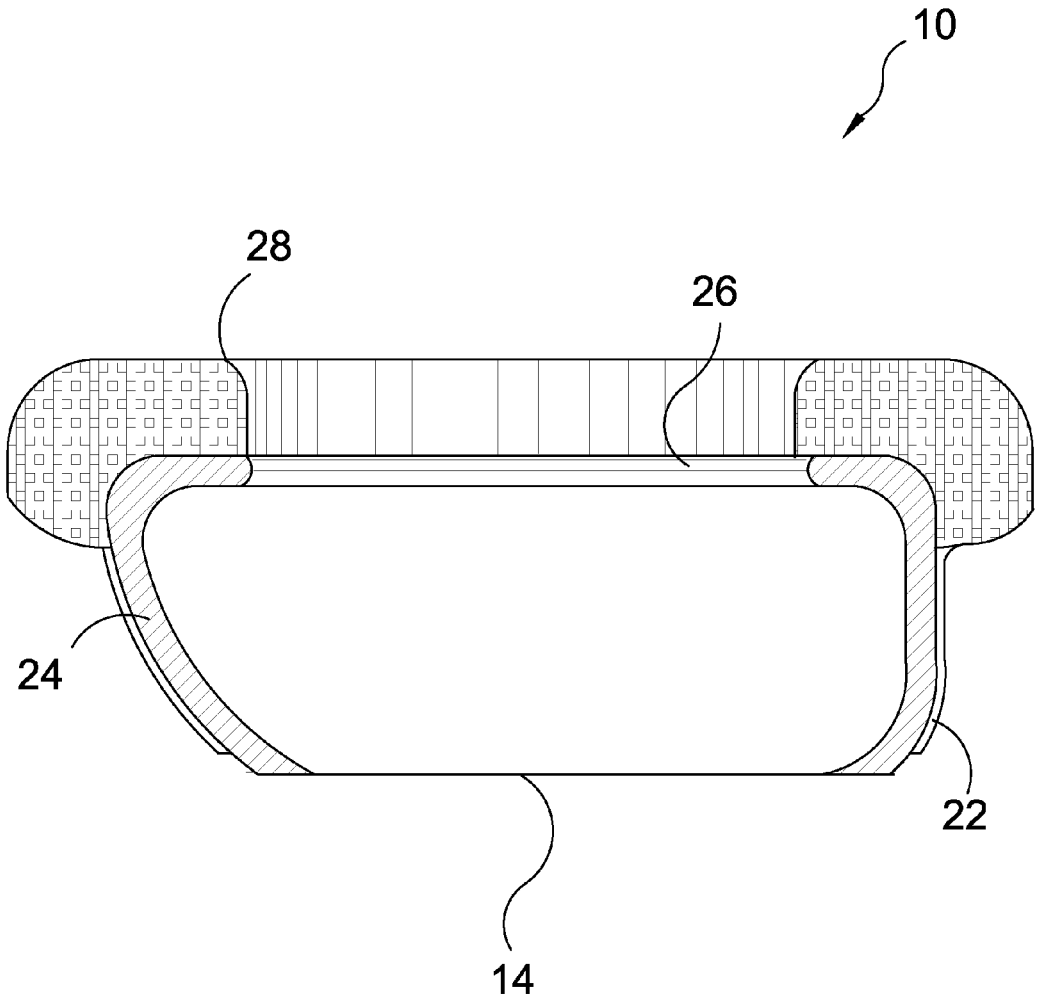

FIG. 9 a side sectional view of the present invention.

Figure 10:
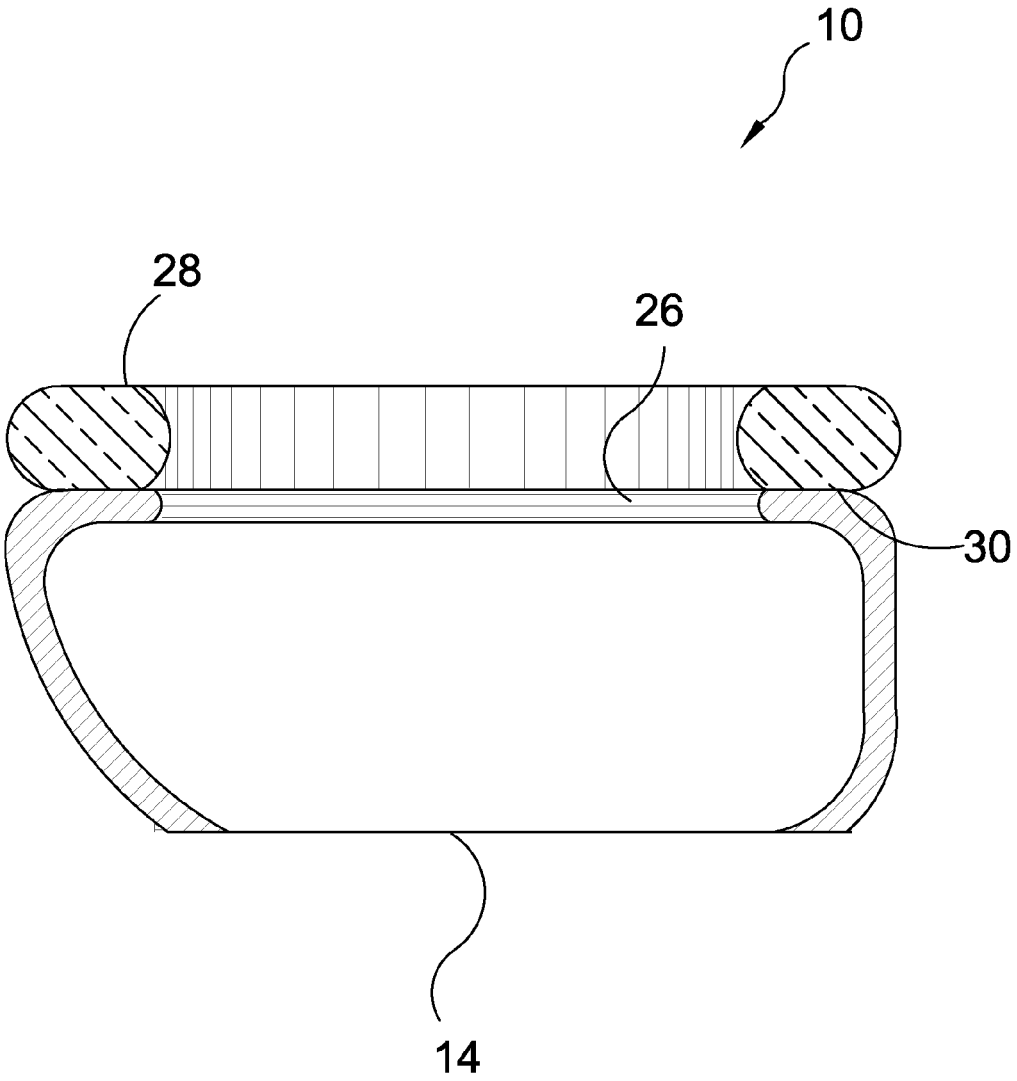

FIG. 10 is a side sectional view of an alternate of the present invention.

DESCRIPTION OF THE REFERENCED NUMERALS

Turning now descriptively to the drawings, in which similar reference characters denote similar elements throughout the several views, the figures illustrate the Gel Enclosed Bed Pan of the present invention. With regard to the reference numerals used, the following numbering is used throughout the various drawing figures.

10 Gel Enclosed Bed Pan of the present invention
12 prior art
14 rigid core member
16 gel material
18 polymeric skin
20 user
22 retaining sleeve
24 body of 14
26 seat of 14
28 cover portion of gel pack
30 bonding agent

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
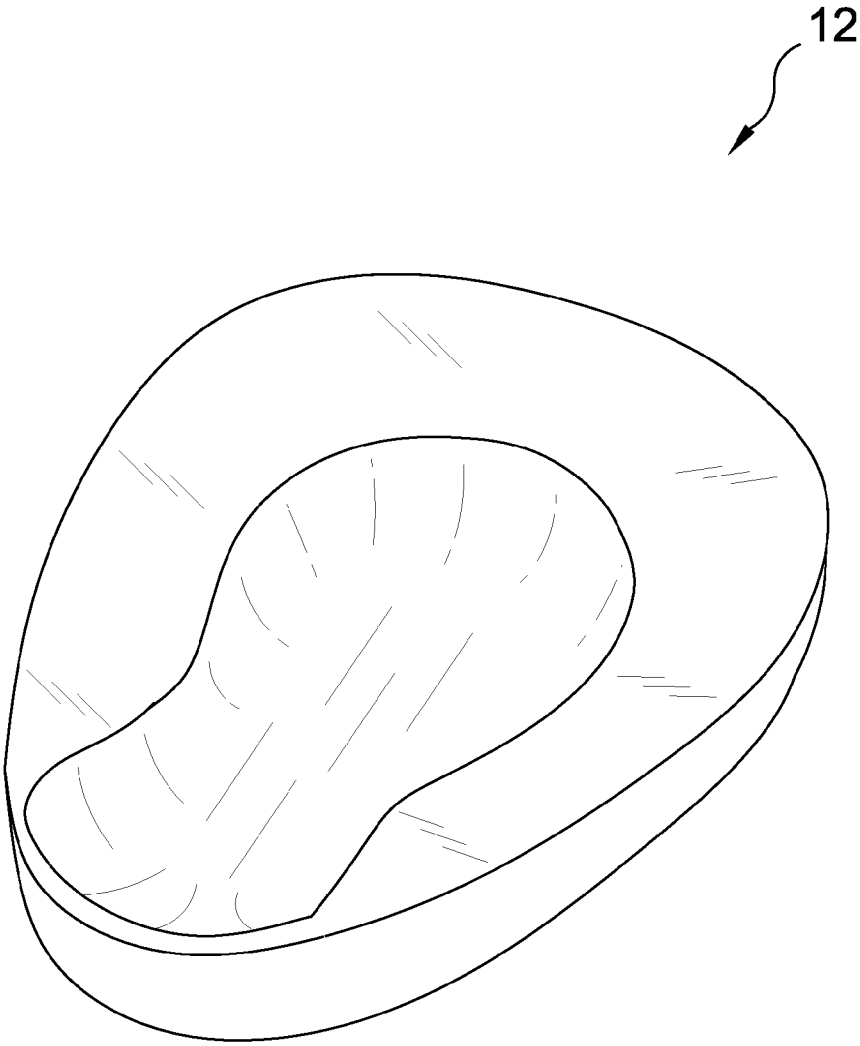
FIG. 1 (PRIOR ART)
FIG. 1 is a perspective view of a bedpan of the prior art.

FIG. 1 is a perspective view of a bedpan 12 of the prior art. A bed pad is a ubiquitous article for bed-ridden patients. They serve a utilitarian function of human waste collection for disposal. They are not designed for comfort but for durability. Comprised of rigid materials such as stainless steel and can be uncomfortable, irritate skin and intensify bedsores. The present invention seeks to overcome these disadvantages by providing a bed pan 12 having a rigid core similar to the current bed pans encased in pliable gel material thereby providing a weight distributing surface to support the user.

Figure 2:
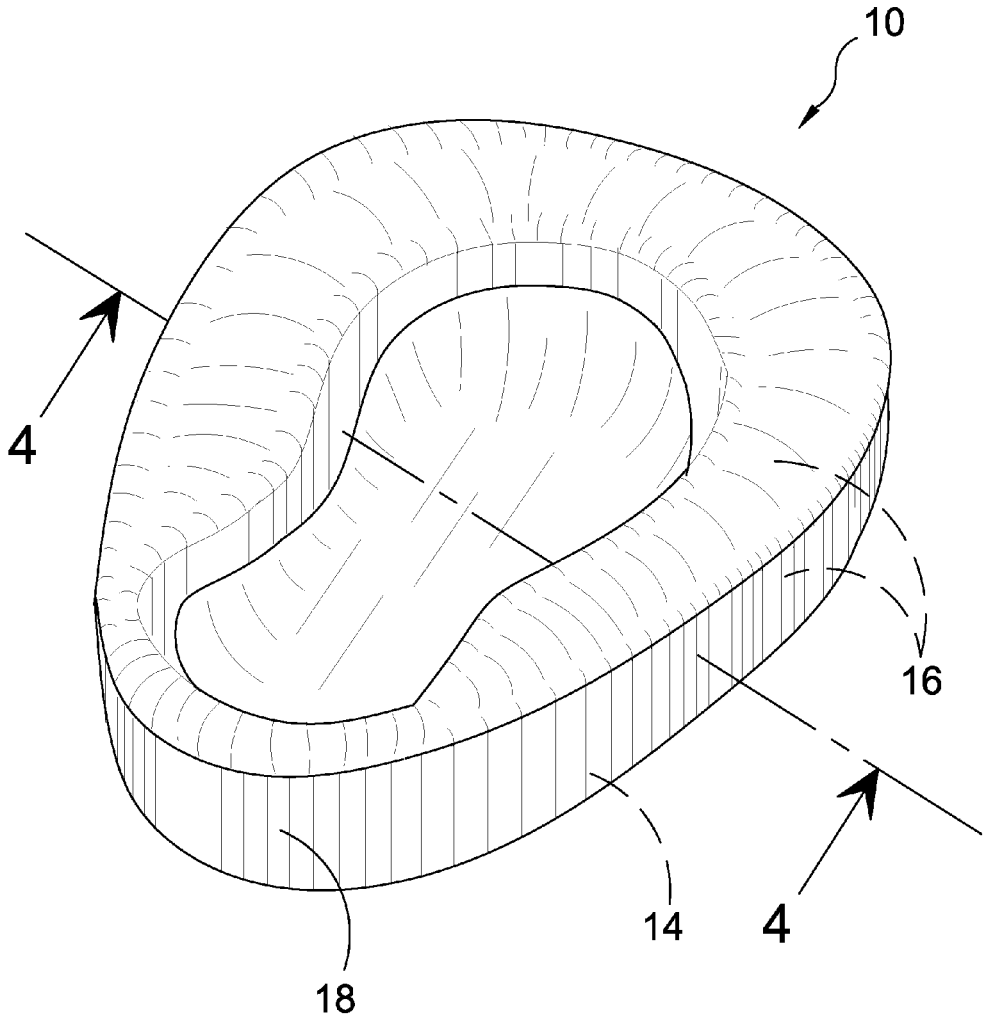
FIG. 2 is a perspective view of the gel-enclosed bedpan of the present invention.

FIG. 2 is a perspective view of the gel-enclosed bedpan 10 of the present invention. Shown is the gel enclosed bed pan 10 of the present invention having a pliable support surface that will contour more to the patient's body rather than the patient's body having to contour to the bed pan. This is accomplished by having a rigid core member 14 encompassed by an appropriate thickness of gel material 16 and a hypoallergenic polymeric skin 18. The bedpan of the present invention can be sterilized as needed and warmed if desired.

Figure 3:
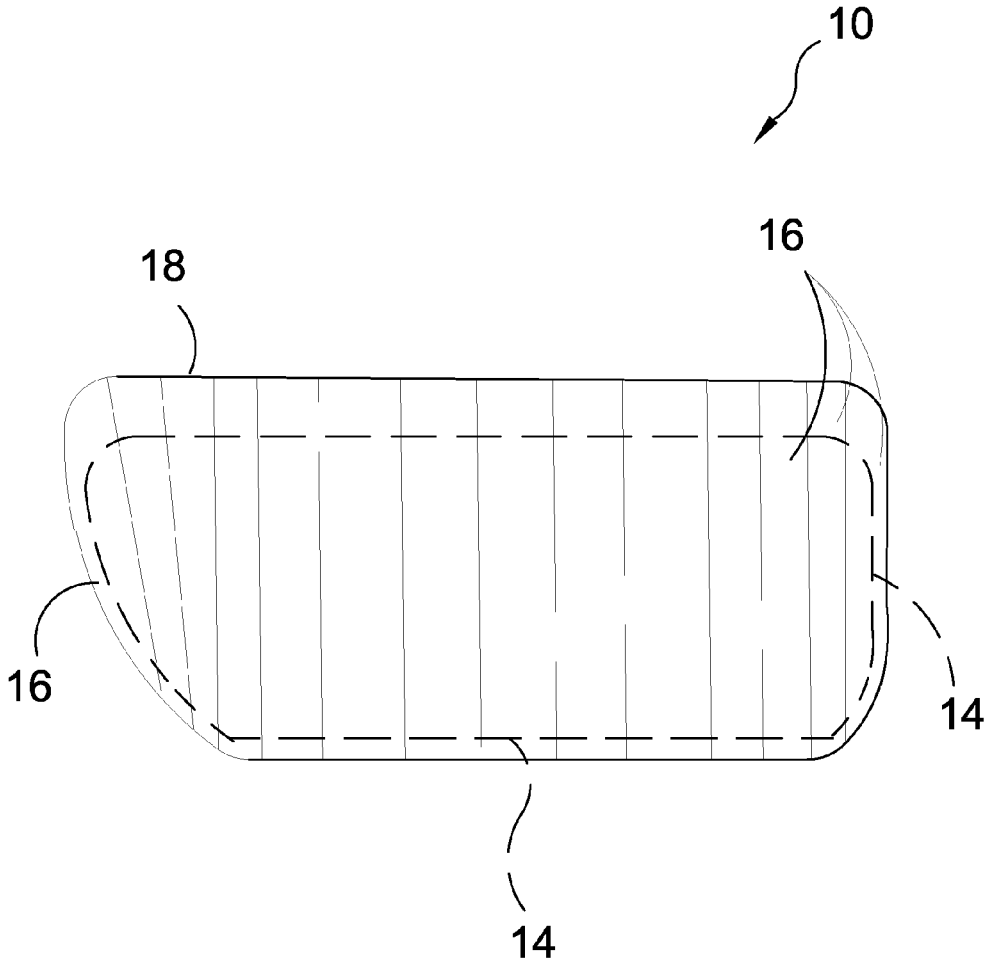
FIG. 3 is an illustrative side view of the present invention.

FIG. 3 is an illustrative side view of the present invention 10. Shown is the gel-enclosed bedpan of the present invention comprising a seamless polymeric covering 18 having a rigid core 14 with a top patient-engaging portion of an appropriate thickness of gel 16.

Figure 4:
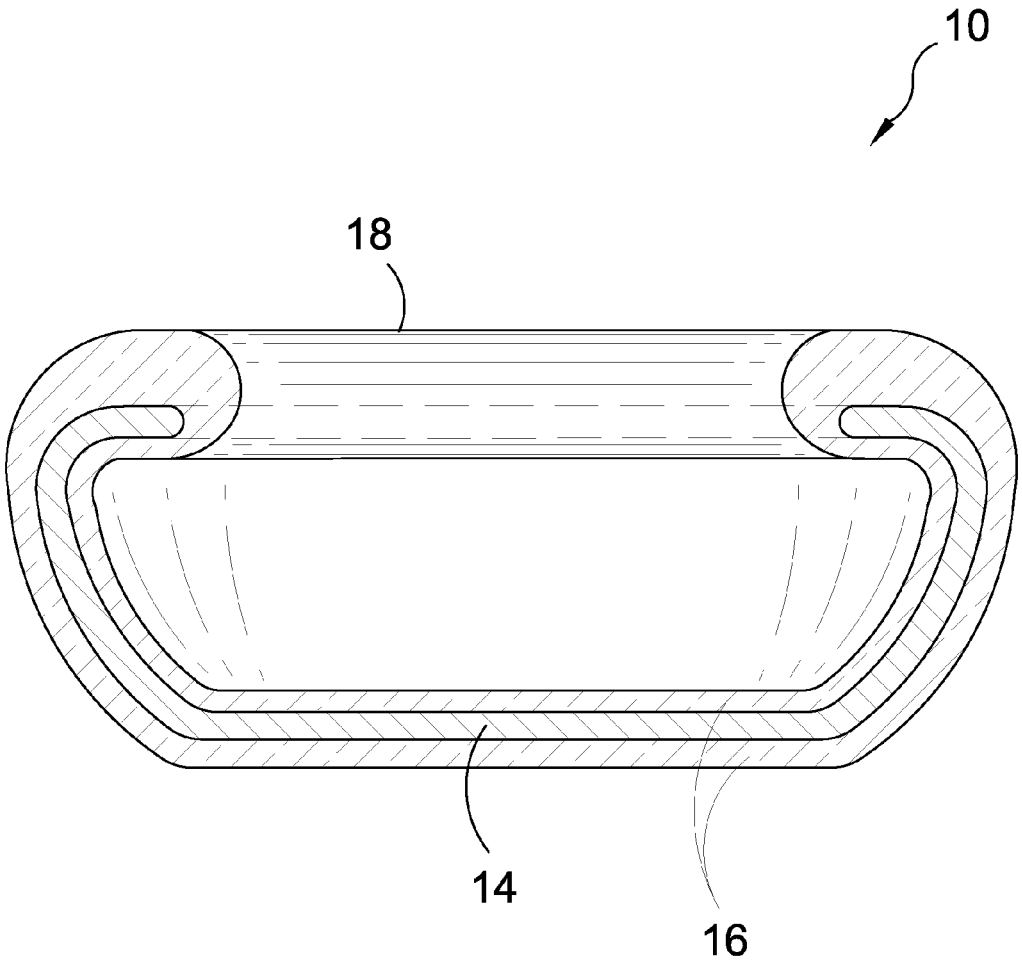
FIG. 4 is a cross sectional view of the present invention.

FIG. 4 is a cross sectional view of the present invention 10. Shown is a cross sectional view taken from FIG. 2 as indicated showing the gel enclosed bed pan of the present invention wherein the surfaces of the rigid core bed pan 14 has a gel 16 filled polymeric casing 18 bonded thereto. As illustrated, the gel covers all surfaces of the rigid core 14.

Figure 5:
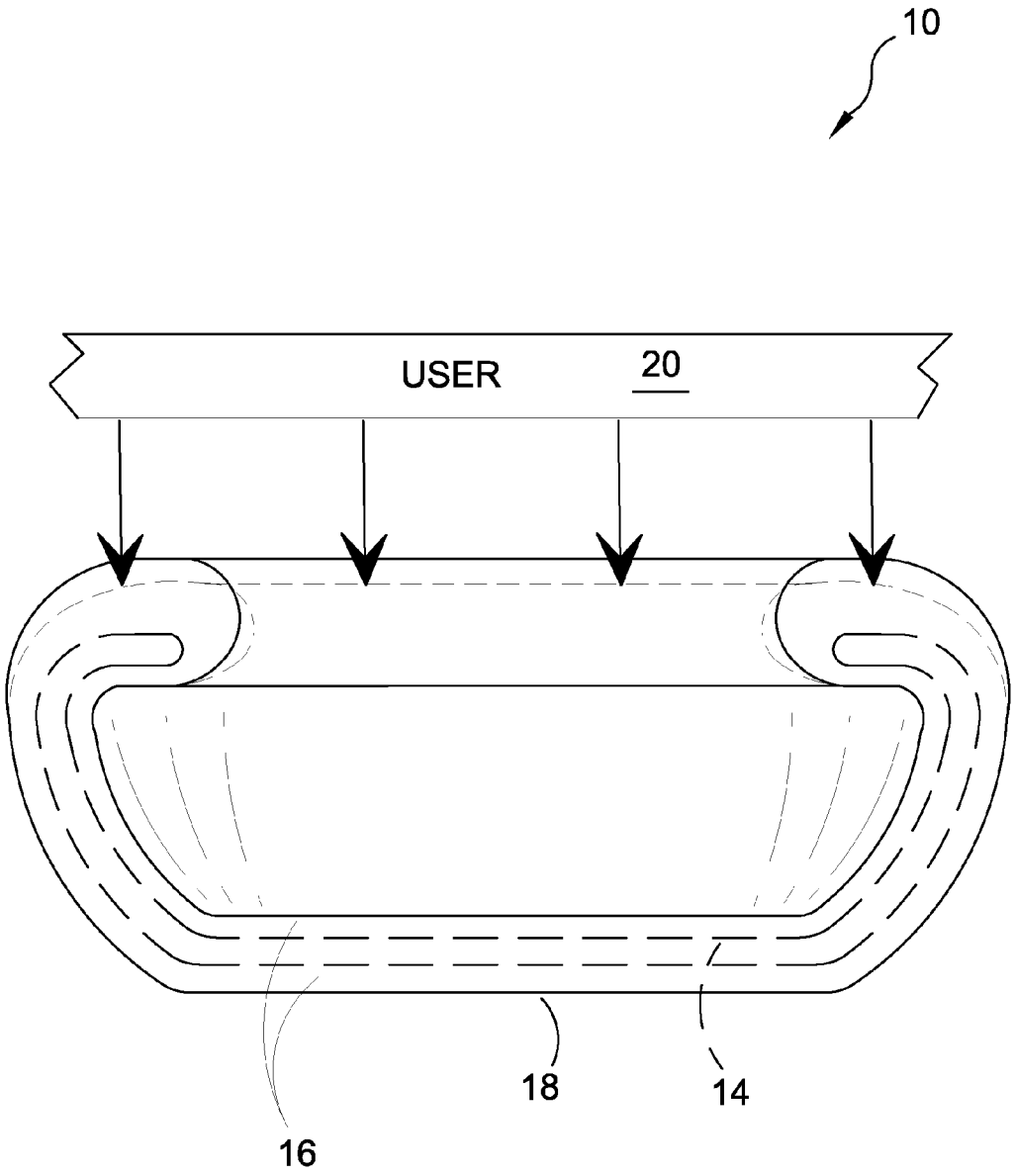
FIG. 5 is an illustrated view of the present invention in use.

FIG. 5 is an illustrated view of the present invention 10 in use. As illustrated, another advantage of the present invention is the greater surface area that will support the user 20 due to the deformability of the gel 16 in the polymeric skin 18 on the rigid core 14 so that the present invention not only conforms to the shape of the user 20 but provides a greater user contact surface area.

Figure 6:
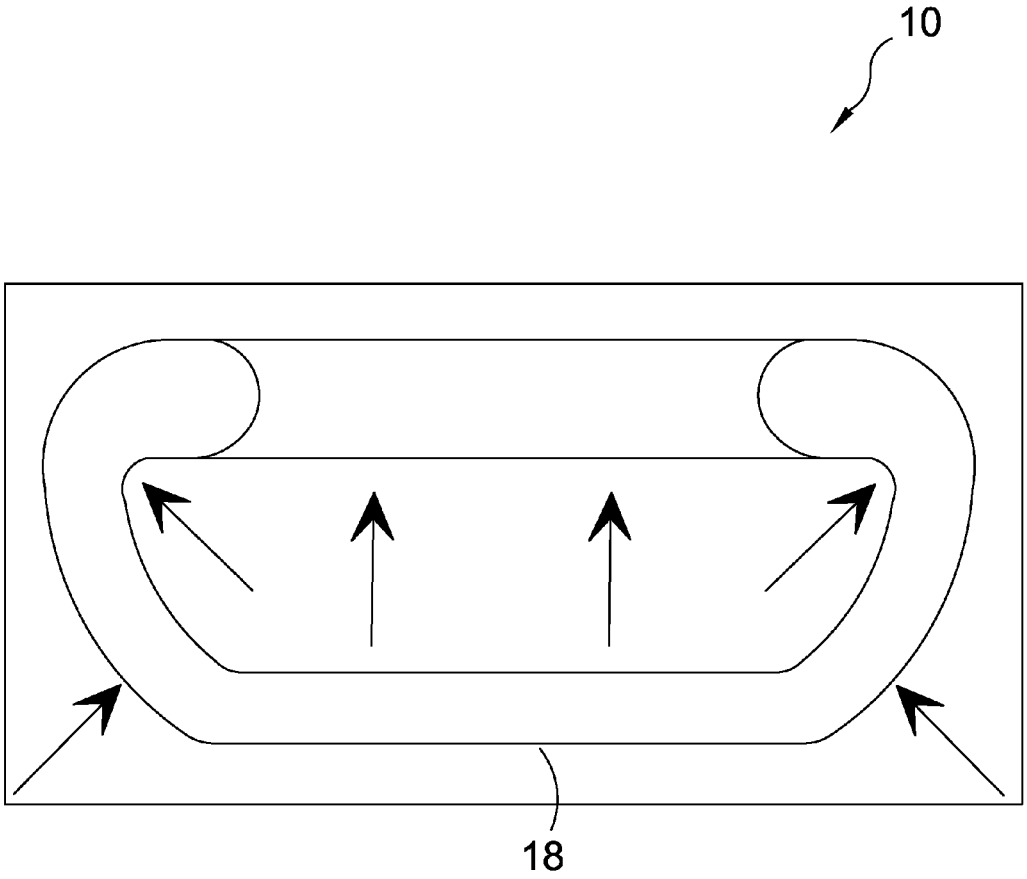
FIG. 6 is an illustrated view of the present invention being sterilized.

FIG. 6 is an illustrated view of the present invention 10 being sterilized. The polymeric cover 18 is imbued with chemical and heat resistant properties with the gel bed pad having a seamless cover so that no portion thereof provides seams that may host bacteria or virus cultures during sterilization.

Figure 7:
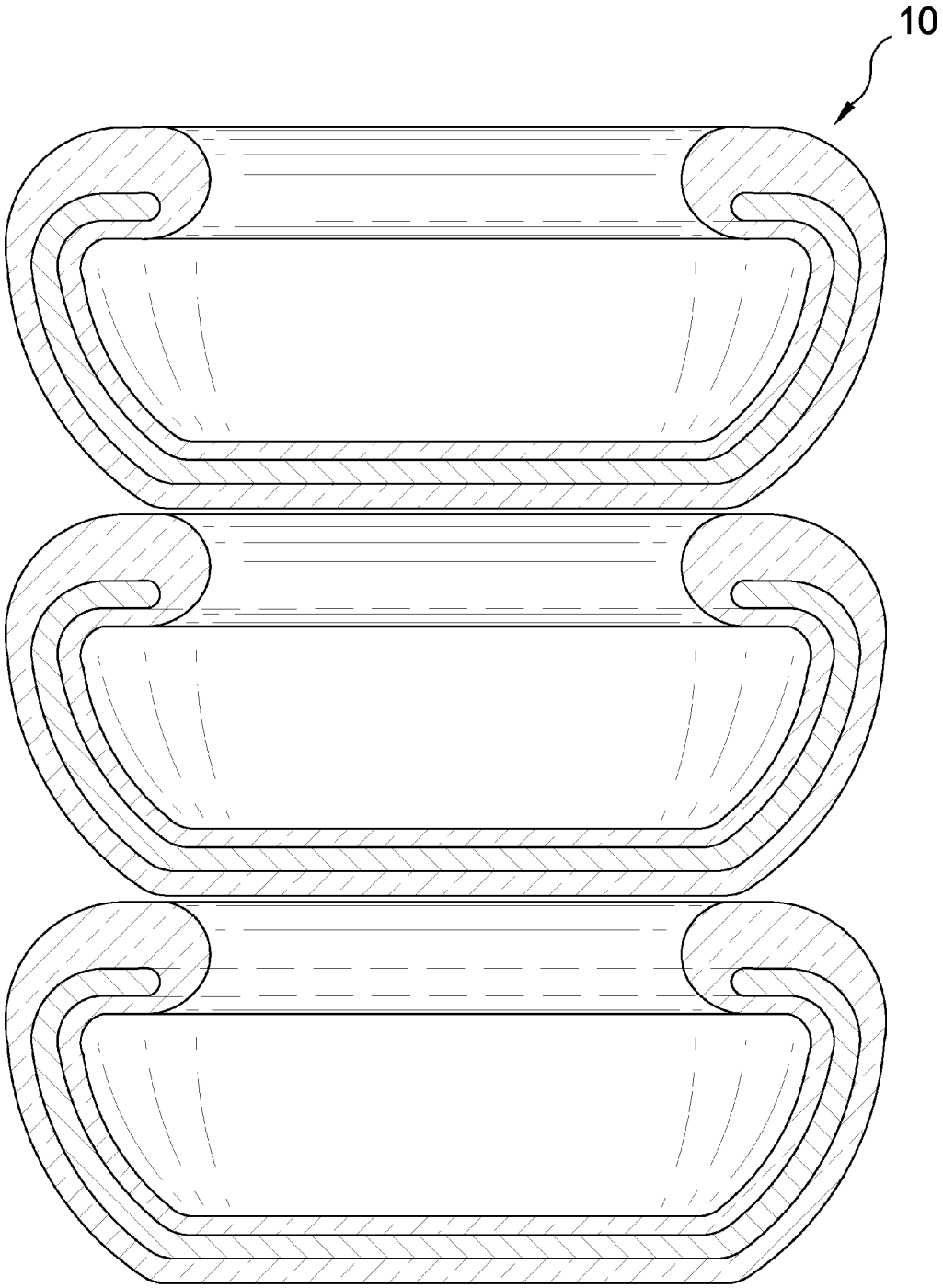
FIG. 7 is an illustrative view of a plurality of the present invention.

FIG. 7 is an illustrative view of a plurality of the present invention 10. Shown is a plurality of the present invention illustrating the stackability of the present invention 10 reducing the amount of storage needed.

Figure 8:
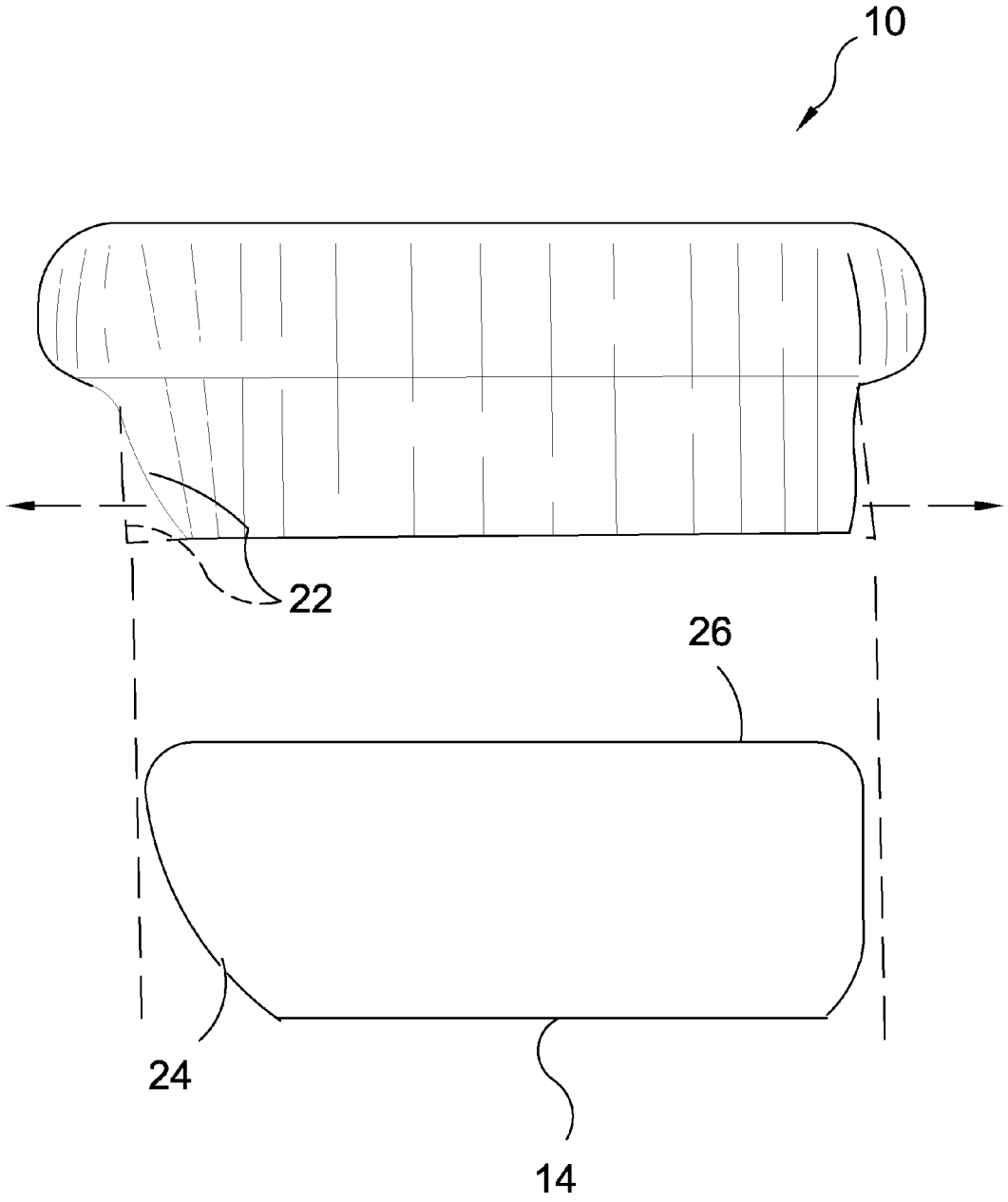
FIG. 8 is an exploded side view of the present invention.

FIG. 8 is an exploded side view of the present invention 10. Shown is the alternate variation of the gel enclosed bed pan of the present invention demonstrating the elasticity of a retaining sleeve 22 which enables the user to expand the bottom portion to fit over the top of the body 24 of the rigid core bed pan 14 and is resilient to tightly grip the narrower portion thereof when released upon contact of the cover portion of the removable gel pack 28 with the seat 26.

FIG. 9 a side sectional view of the present invention 10. Shown is an alternate variation of the gel-enclosed bedpan of the present invention wherein the exterior surfaces of the seat 26 and body 24 have a gel-padded cover 28 and integral retaining sleeve 22 encompassing them. The gel pad cover 28 and sleeve 22 are comprised of a polymeric or elastomeric material and is selectively removable and replacable.

FIG. 10 is a side sectional view of an alternate of the present invention 10. Shown is the gel pack cover 28 secured to the seat 26 of the rigid core bed pan 14 with a bonding agent 30.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A gel pack covered bed pan to enhance the comfort and sanitation of the user comprising:

a) a rigid core member shaped in the form of a bed pan having a bottom, sides and an open top surrounded by a seat and forming a rigid internal skeletal structure;

b) a gel pack comprising a gel material encapsulated by a seamless hypoallergenic polymeric skin covering all surfaces of said rigid core member so that no portion thereof provides seams that may host bacteria or virus cultures during sterilization;

c) said bed pan adapted for being stacked; and d) said gel enclosed bed pan is heat and chemical resistant for sterilization purposes.

2. The gel pack covered bed pan according to claim 1, wherein said gel pack is bonded to the exterior of said rigid core member.

3. The gel pack covered bed pan according to claim 2, providing a pliable support surface that contours to the patient's body.

4. The gel pack covered bed pan according to claim 3, further including a polymeric skin retaining sleeve.

5. The gel pack covered bed pan according to claim 4, wherein said retaining sleeve has elastomeric properties.

6. The gel pack covered bed pan according to claim 5, wherein said removable gel pack is installed by stretching said retaining sleeve and placing it over said core structure and releasing it to frictionally engage therewith.

* * * * *